US011783848B2

(12) United States Patent
Bi et al.

(10) Patent No.: US 11,783,848 B2
(45) Date of Patent: Oct. 10, 2023

(54) METHOD AND SYSTEM FOR VOICE SEPARATION BASED ON DEGENERATE UNMIXING ESTIMATION TECHNIQUE

(71) Applicant: HARMAN INTERNATIONAL INDUSTRIES, INCORPORATED, Stamford, CT (US)

(72) Inventors: Xiangru Bi, Shanghai (CN); Guoxia Zhang, Shanghai (CN); Youye Xie, Shanghai (CN); Qingshan Zhang, Shanghai (CN)

(73) Assignee: Harman International Industries, Incorporated, Stamford, CT (US)

( * ) Notice: Subject to any disclaimer, the term of this patent is extended or adjusted under 35 U.S.C. 154(b) by 217 days.

(21) Appl. No.: 17/432,018

(22) PCT Filed: Feb. 26, 2019

(86) PCT No.: PCT/CN2019/076140
§ 371 (c)(1),
(2) Date: Aug. 18, 2021

(87) PCT Pub. No.: WO2020/172790
PCT Pub. Date: Sep. 3, 2020

(65) Prior Publication Data
US 2022/0139415 A1 May 5, 2022

(51) Int. Cl.
*G10L 21/0272* (2013.01)
*G10L 21/0308* (2013.01)
(Continued)

(52) U.S. Cl.
CPC ..... *G10L 21/0308* (2013.01); *G10L 21/055* (2013.01); *G10L 21/06* (2013.01)

(58) Field of Classification Search
CPC ..... G10L 21/0308; G10L 21/0272
See application file for complete search history.

(56) References Cited

U.S. PATENT DOCUMENTS 9,460,732 B2 10/2016 Wingate et al.
2002/0042685 A1* 4/2002 Balan ..... G06F 18/21347 702/75

FOREIGN PATENT DOCUMENTS

CN 101727908 A 6/2010
CN 104167214 A 11/2014
(Continued)

OTHER PUBLICATIONS

Blind Source Separation of Music Streams using DUET, Declan Quinn, May 3, 2006, IEEE Transactions on Speech and Audio Processing (Year: 2006).*
(Continued)

*Primary Examiner* — Thomas H Maung
(74) *Attorney, Agent, or Firm* — Brooks Kushman P.C.

(57) ABSTRACT

The present disclosure provides method and system for voice separation based on DUET algorithm, and the method comprises receiving signals from microphones; performing a Fourier transform on the received signals; calculating a relative attenuation parameter and a relative delay parameter for each data point; selecting a clustering range for the relative delay parameters based on a distance between the microphones and a sampling frequency of the microphones, clustering the data points within the clustering range for the relative delay parameters into subsets, and performing an inverse Fourier transform on each subsets. According to the present disclosure, it is possible to provide an efficient and intelligent solution to deploy DUET on the software and/or hardware.

17 Claims, 6 Drawing Sheets

(51) Int. Cl.
*G10L 21/055* (2013.01)
*G10L 21/06* (2013.01)

(56) References Cited

FOREIGN PATENT DOCUMENTS

| | | | |
|---|---|---|---|
| CN | 104995679 | A | 10/2015 |
| CN | 108447493 | A | 8/2018 |
| JP | 2018040880 | A | 3/2018 |

OTHER PUBLICATIONS

Blind Separation of Speech Mixtures via Time-Frequency Masking, Ozgur Yilmaz, Jul. 2004, IEEE Transactions on Signal Processing, vol. 52. (Year: 2004).*
Phase aliasing correction for robust blind source separation using DUET, Yang Wang, Ozgur Yilmaz, 2013, Elsevier (Year: 2013).*
Rickard, S., "The DUET blind source separation algorithm", In Blind Speech Separation, Jan. 2007, 26 pgs.
International Search Report dated Dec. 3, 2019 for PCT Appn. No PCT/CN2019/076140 filed Feb. 26, 2019, 10 pgs.

* cited by examiner

METHOD AND SYSTEM FOR VOICE SEPARATION BASED ON DEGENERATE UNMIXING ESTIMATION TECHNIQUE

CROSS-REFERENCE TO RELATED APPLICATION

This application claims priority to PCT Patent Application No. PCT/CN2019/076140, filed Feb. 26, 2019, and entitled "METHOD AND SYSTEM FOR VOICE SEPARATION BASED ON DEGENERATE UNMIXING ESTIMATION TECHNIQUE", the entire disclosure of which is incorporated herein by reference.

TECHNICAL FIELD

The present disclosure relates to voice processing, and more particularly, relates to a method and a system for voice separation based on Degenerate Unmixing Estimation Technique (DUET) algorithm.

BACKGROUND

Due to the increasing demand of the intelligent lifestyle and connected car, voice separation, as a critical part of the man-machine interaction system, has been pervasive in the industry. There are two main methods of voice separation, wherein one is to use a microphone array to achieve speech enhancement, and the other one is to use a blind source separation algorithm, such as, Frequency Domain Independent Component Analysis (FDICA), Degenerate Unmixing Estimation Technique (DUET) algorithm, or their extended algorithm.

The DUET algorithm may separate any number of sources using only two mixtures, which is well suited for the voice separation within a relatively small space. The technique is valid even in the case when the number of sources is larger than the number of mixtures. The DUET algorithm separates the speeches based on the relative delay and attenuation pairs extracted from the mixtures. However, the appropriate range for clustering the relative delay and attenuation in the DUET algorithm is important but very ambiguous because the range is usually selected based on the experience, and the phase wrap effect may not be negligible if there are many invalid data points inside the selected range. Therefore, there is a need for a method and a system for selecting the appropriate range for clustering to improve the voice separation.

Further, the DUET algorithm usually requires time synchronization of the sources, while the traditional time synchronous method may not reach the requirement because the sampling frequency of the microphones may be up to several tens of kilohertz or more, while the system time is usually in milliseconds. Therefore, a new method and system are proposed hereinafter to achieve more accurate time synchronization.

SUMMARY OF THE INVENTION

According to one aspect of the disclosure, a method for voice separation based on DUET is provided, which comprises receiving signals from microphones; performing a Fourier transform on the received signals; calculating a relative attenuation parameter and a relative delay parameter for each data point; selecting a clustering range for the relative delay parameters based on a distance between the microphones and a sampling frequency of the microphones, clustering the data points within the clustering range for the relative delay parameters into subsets, and performing an inverse Fourier transform on each subsets.

Typically, the range of the relative attenuation parameters may be set as a constant.

Typically, the method may be implemented in a head unit of the vehicle. Further, the method may be implemented in other environments, such as, an indoor environment (e.g., an office, home, shopping mall), an outdoor environment (e.g., a kiosk, a station), etc.

Typically, the step of selecting the clustering range for the relative delay parameters is further based on the maximum frequency in the voice.

Typically, the clustering range for the relative delay parameters is related to the relationship between a distance between the microphones and a ratio between a speed of the sound and a maximum frequency in the speech.

Typically, the clustering range for the relative delay parameters in terms of the sampling point may be given by:

$$\left[-\frac{f_s}{2f_{MAX}},\ \frac{f_s}{2f_{MAX}}\right] \cap \left[-f_s\frac{d}{c}-n_0,\ f_s\frac{d}{c}+n_0\right]$$

wherein $f_s$ is the sampling frequency of the microphones, d is the distance between the microphones, $f_{max}$ is the maximum frequency in the speech, c is the speed of the sound, and $n_0$ is the largest synchronization error of the microphones in terms of data points.

Typically, the method may generate a synchronous sound by a speaker to synchronize the signals received by the microphones. The synchronous sound may be generated once or periodically, and may be ultrasonic sound so that it is inaudible to humans. After synchronization, the largest synchronization error of the microphones in terms of data points ($n_0$) may be equal to 0.

According to another aspect of the disclosure, a system for voice separation based on DUET is provided. The system comprises a sound recording module configured to store signals received from the microphones; a processor configured to perform a Fourier transform on the received signals, calculate a relative attenuation parameter and a relative delay parameter for each data point, select a clustering range for the relative delay parameters based on a distance between the microphones and a sampling frequency of the microphones, cluster the data points within the clustering range for the relative delay parameters into subsets, and perform an inverse Fourier transform on each subsets.

The system may be included in the head unit of the vehicle. Further, the system may be implemented in other environments, such as, an indoor environment (e.g., an office, home, shopping mall), an outdoor environment (e.g., a kiosk, a station), etc.

The system may further include a speaker configured to generate a synchronous signal for synchronizing the signals received from the microphones. The system may further include a synchronizing and filtering module configured to synchronize the signals received from the microphones with the synchronous signal and filter out the synchronous signal from the received signals.

According to the present disclosure, it is possible to provide an efficient and intelligent solution to deploy DUET on the software and/or hardware. It is also possible to provide a solution to achieve more accurate time synchronization of the signals to be processed by DUET.

The significance and benefits of the present disclosure will be clear from the following description of the embodiments. However, it should be understood that those embodiments are merely examples of how the invention can be implemented, and the meanings of the terms used to describe the invention are not limited to the specific ones in which they are used in the description of the embodiments.

Others systems, method, features and advantages of the disclosure will be, or will become, apparent to one with skill in the art upon examination of the following figures and detailed description. It is intended that all such additional systems, methods, features and advantages be included within this description, be within the scope of the disclosure, and be protected by the following claims.

BRIEF DESCRIPTION OF THE DRAWINGS

The disclosure can be better understood with reference to the flowing drawings and description. The components in the drawings are not necessarily to scale, emphasis instead being placed upon illustrating the principles of the disclosure. Moreover, in the figures, like reference numerals designate corresponding parts throughout the different views.

FIG. 4A and FIG. 4B are graphs illustrating a clustering result for the speeches of four passengers in a vehicle by using an example of a system for voice separation of the present disclosure, wherein FIG. 4B is the top view of FIG. 4A;

DETAILED DESCRIPTION OF EMBODIMENTS

Hereinafter, the preferred embodiment of the present disclosure will be described in more detail with reference to the accompanying drawings. In the following description of the present disclosure, a detailed description of known functions and configurations incorporated herein will be omitted when it may make the subject matter of the present disclosure rather unclear.

Figure 1:
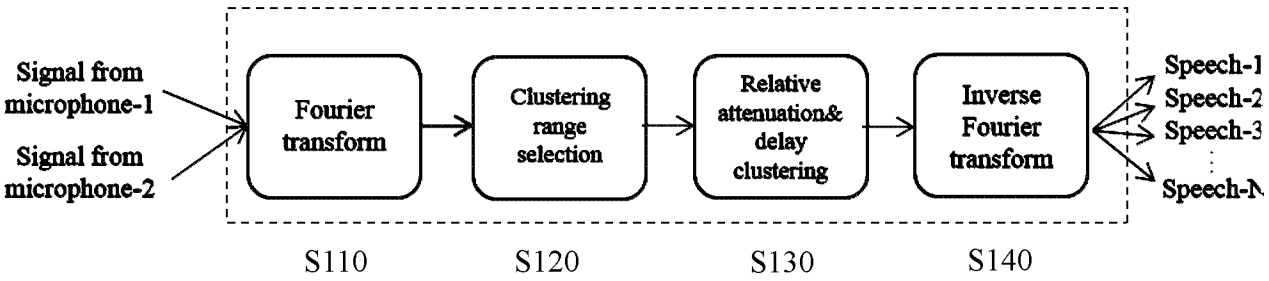
FIG. 1 is a flow process diagram of a method for voice separation based on DUET according to an embodiment of the present disclosure.

The present disclosure provides a method and a system for voice separation based on DUET. FIG. 1 is a flow process diagram of a method for voice separation based on DUET. The method may be used in various environments, such as, a vehicle cabin, an office, home, shopping mall, a kiosk, a station, etc.

As shown in FIG. 1, the microphones (two microphones are shown as an example) receive the sound and sample the sound, which may include multiple sources. The sampling frequency of the microphones may be on the order of kilohertz, tens of kilohertz, or even higher. A higher sampling frequency would benefit the separation process since less information is lost during the discretization. If the sound includes multiple sources, the signals sampled by microphone 1 and the signals sampled by microphone 2 would be mixtures each including the signals from multiple sources.

The received signals from microphone 1 and microphone 2 are inputted in the DUET module (not shown in FIG. 1), which performs the signal demixing (as shown in the dotted box in FIG. 1).

First, the Fourier transform (e.g., short-time Fourier transform, windowed Fourier transform) on the received signals are performed to output a lot of time-frequency data points (step S110).

In order to partition the time-frequency data points, a relative delay and a relative attenuation parameter for each data point are calculated, where the relative delay parameter is related to the time difference between the arrival times from a source to two microphones, and the relative attenuation parameter corresponds to the ratio of the attenuations of the paths between a source and two microphones (step S120). The relative delay and the relative attenuation pairs corresponding to one of the sources should be respectively different from those corresponding to another one of the sources, and thus the time-frequency points may be partitioned according to the different relative delay-attenuation pairs. That is to say, the data points within the clustering ranges of the relative attenuation and the relative delay parameters may be clustered into several subsets (step S130). Finally, the inverse Fourier transform (e.g., the inverse short time Fourier transform) may be performed on each subsets to output the separated signals corresponding to different sources (step S140).

The clustering ranges for the relative attenuation and relative delay parameters are selected intelligently in step S120.

Since the relative attenuation is normally small given the small relative delay required by DUET, the range of the relative attenuation may simply be set as a constant, e.g., [−0.7, 0.7], [−1.0, 1.0]. If two microphones are provided close enough (e.g., around 15 centimeters), the relative attenuation may be substantially determined by the distance therebetween.

As to the relative delay, a range within which the relative delay can be uniquely determined when the signal's true relative delay lies within this range. Such a range is called an effective range in the present disclosure.

In order to clarify the process of determining the effective range for the relative delay, the following parameters are defined as follows:

$f_s$ (unit: Hz): sampling frequency of the microphones;

f (unit: Hz): frequency of the continuous voice signal;

$f_{MAX}$ (unit: Hz): the maximum frequency in the voice;

ω (unit: rad/s): frequency of the continuous voice signal ($\omega=2\pi f$);

δ (unit: second): relative delay between signals received by two microphones;

n (unit: sampling point): relative delay between signals received by two microphones in terms of sampling points;

d (unit: meter): microphones separation distance;

c (unit: m/s): speed of the sound.

If the voice is human speech, f is the frequency of the continuous speech signal; $f_{MAX}$ is the maximum frequency in the speech; and ω is the frequency of the continuous speech signal with the unit rad/s.

The relative delay is set as $e^{-i\omega\delta}$, which has a property that $e^{-i\omega\delta}=e^{-i(\omega\delta+2\pi)}$. Therefore, $\omega\delta$ can only be uniquely determined when $|\omega\delta|\leq\pi$, and if $|\omega\delta|>\pi$, a wrong delay would be returned and this phenomenon is called as the phase wrap effect.

It is assumed that the microphones are synchronized. Then, the effective range of the relative delay for a signal with frequency f is given by $$|\omega\delta| \leq \pi \Rightarrow |\delta| \leq \frac{\pi}{2\pi f} \Rightarrow \delta \in \left[-\frac{1}{2f}, \frac{1}{2f}\right] \tag{1}$$

And the intersection of the effective ranges of all frequencies in the speech is $$\delta \in \left[-\frac{1}{2f_{MAX}}, \frac{1}{2f_{MAX}}\right] \tag{2}$$

When the continuous signals are discretized with the sampling frequency $f_s$, the effective range in terms of sampling points becomes $$f_s\delta = n \in \left[-\frac{f_s}{2f_{MAX}}, \frac{f_s}{2f_{MAX}}\right] \tag{3}$$

Thus, if the relative delay of the speech from any direction with maximum frequency $f_{MAX}$ lies inside the effective range, a critical point of d is determined as follows:

$$d = \frac{c}{2f_{MAX}} \tag{4}$$

The maximum frequency $f_{max}$ may be determined by measurement or may be preset based on the frequency range of the sound of interest.

When $$d < \frac{c}{2f_{MAX}},$$

the effective range is larger than the largest relative delay between those two microphones, this provides $$\left[-\frac{f_s}{2f_{MAX}}, \frac{f_s}{2f_{MAX}}\right] \supset \left[-f_s\frac{d}{c}, f_s\frac{d}{c}\right]. \tag{5}$$

When $$d = \frac{c}{2f_{MAX}},$$

$$\left[-\frac{f_s}{2f_{MAX}}, \frac{f_s}{2f_{MAX}}\right] = \left[-f_s\frac{d}{c}, f_s\frac{d}{c}\right]. \tag{6}$$

Therefore, when $$d \leq \frac{c}{2f_{MAX}},$$

the selected range is $$\left[-f_s\frac{d}{c}, f_s\frac{d}{c}\right].$$

Within the range, there is no phase wrap effect, and no signal of interest would lie outside this range for the synchronized microphones. That is to say, if d is small enough, the selected range of the relative delay for the synchronized microphones would be $$\left[-f_s\frac{d}{c}, f_s\frac{d}{c}\right].$$

When $$d > \frac{c}{2f_{MAX}}, \tag{7}$$

$$\left[-\frac{f_s}{2f_{MAX}}, \frac{f_s}{2f_{MAX}}\right] \subset \left[-f_s\frac{d}{c}, f_s\frac{d}{c}\right].$$

In this case, the selected range for the relative delay is $$\left[-\frac{f_s}{2f_{MAX}}, \frac{f_s}{2f_{MAX}}\right].$$

There is no phase wrap effect when the true relative delay lies within this range. Since the effective range is smaller than the largest relative delay between those two microphones, it is possible that there is a signal whose relative delay lies outside the effective range $$\left[-\frac{f_s}{2f_{MAX}}, \frac{f_s}{2f_{MAX}}\right].$$

Figures 2A, 2B:
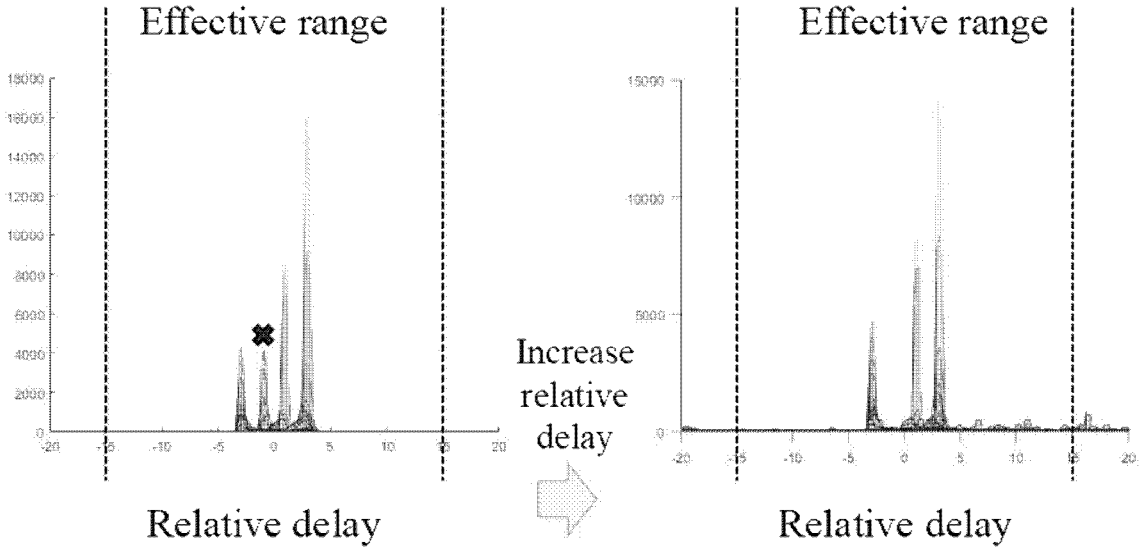
FIG. 2A is a schematic graph illustrating an example of the clustered subsets of the relative attenuation and relative delay pairs of the data points according to the embodiment of the present disclosure.
FIG. 2B is a schematic graph illustrating an example of the subsets of the relative attenuation and relative delay pairs of the data points in which the phase wrap effect occurs.

It so, me phase wrap effect would occur and its relative delay may spread across the axis (see FIG. 2B). Some of the shifted data points may fall inside the selected range. Nonetheless, those shifted points within the selected range are negligible and would not affect the clustering result of the signals within the range. Accordingly, the data points outside the effective range would be discarded.

Therefore, the clustering range for the relative delay parameters for the synchronized microphones in terms of the sampling point is given by:

$$\left[-\frac{f_s}{2f_{MAX}}, \frac{f_s}{2f_{MAX}}\right] \cap \left[-f_s\frac{d}{c}, f_s\frac{d}{c}\right] \tag{8}$$

For non-synchronized microphones, the selected range would be, $$\left[-\frac{f_s}{2f_{MAX}}, \frac{f_s}{2f_{MAX}}\right] \cap \left[-f_s\frac{d}{c} - n_0, f_s\frac{d}{c} + n_0\right], \quad (9)$$

where $n_0$ is the measured largest synchronization error of the system in terms of the sampling points.

FIG. 2A is a schematic graph illustrating an example of the clustered subsets of the relative attenuation and relative delay pairs of the data points within a clustering range calculated by the method according to the embodiment of the present disclosure, and FIG. 2B is a schematic graph illustrating an example of the subsets of the relative attenuation and relative delay pairs of the data points in which the phase wrap effect occurs.

As shown in FIG. 2A, there are four subsets of the relative attenuation-delay pairs within the clustering range of the relative delay (which is illustrated by the vertical dotted lines. This entails that there are four sources that may be recovered. There is no phase wrap effect because the relative delays are all within the clustering range.

If the relative delay of the speech marked by the cross is moved beyond the clustering range (for example, the person corresponding to the subset marked by the cross walks away), the phase wrap effect would occur as shown in FIG. 2B. The corresponding data points may spread across the relative delay axis, but those shifted points would not affect the clustering of the signals within the range. The signals lying outside the range may be discarded.

The method in the aforesaid embodiments of the present disclosure may realize the voice separation. The method may select a clustering range automatically based on the system settings. During the voice separation, there is either no phase wrap effect or the phase wrap effect is negligible and any data points outside the range may be. This ensures the recovery and accuracy of the voice separation and makes the computation more efficient.

Figure 3:
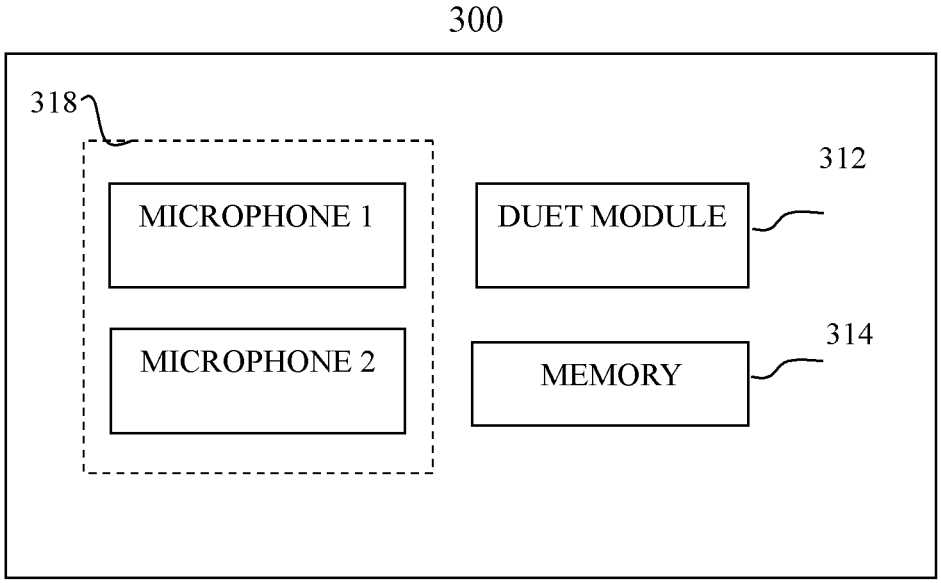
FIG. 3 is a block diagram of the system for voice separation based on DUET according to an embodiment of the present disclosure.

FIG. 3 is a block diagram of the system for voice separation based on DUET according to an embodiment of the present disclosure.

One or more of microphones 318 may be considered as a part of the system 300 or may be considered as being separate from the system 300. The number of microphones as shown in FIG. 1 and FIG. 3 should not be understood as limiting, but merely as being chosen for illustrating purposes, and the number of microphones may be more than two. Microphones 318 sense the sound in the surrounding environment and send out the sampled signals for further processing.

The system includes a DUET module 312 for performing the voice separation and a memory 314 for recording the signals received from the microphones. The DUET module 312 may be implemented by hardware, software, or any combination thereof, such as, the software program performed by a processor. If the system 300 is included in a vehicle, the DUET module 312 or even the system 300 may be realized by or a part of the head unit of the vehicle.

The DUET module 312 may perform the processes in the dotted block as shown in FIG. 1.

The system does not require manual adjustment of the clustering range, and may be implemented with relatively low cost and relatively less complexity. In addition, the system may be adapt to various scenarios, such as, a vehicle cabin, an office, home, shopping mall, a kiosk, a station, etc.

Figure 4A:
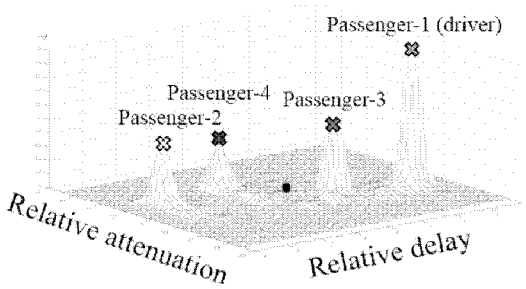
Figure 4B:
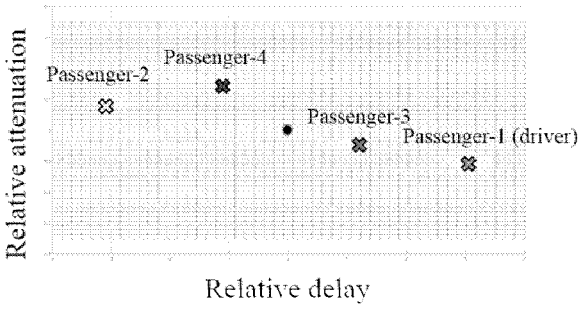

For illustrative purposes, the embodiment is described by taking a vehicle as an example hereinafter. FIG. 4A and FIG. 4B are graphs illustrating a clustering result for the speeches of four passengers in a vehicle according an example of a system for voice separation of the present disclosure, wherein the graph in FIG. 4B is the top view the graph of FIG. 4A.

As shown in FIG. 4A, the coordinate system includes three axes, i.e., the axis of the relative delay, the axis of the relative attenuation, and the axis of the weight. The circle in the center of the plane defined by the axis of the relative delay and the axis of the relative attenuation is the origin point (0, 0). FIG. 4B shows the graph corresponding to FIG. 4A, which omits the axis of the weight.

In the present embodiment, the maximum frequency in the speech $f_{MAX}$ is set to 1100 Hz since the human voice frequency is usually within 85~1100 Hz. The speed of sound c may be determined based on the ambient temperature and humidity. The sampling frequency of the microphones $f_s$ is known, such as, 32 KHz, 44.1 Khz, etc. The largest synchronization error of the microphones in terms of sampling points no may be measured automatically. After the time synchronization of the microphones, the largest synchronization error no may be very small or even equal to zero (see the embodiment with reference to FIG. 5). The DUET module calculates the range of the relative delay based on the equation (9). The range of the relative attenuation is set as a constant as described with reference to FIG. 1.

As shown in FIG. 4A and FIG. 4B, the clustered subsets of the relative delay and attenuation pairs correspond to the speeches of four passengers. Which subset belongs to which passenger may be determined based on the relative phase difference and relative attenuation, and thus, it is possible to determine the driver's request. Further, after setting the range of the relative delay according to the method of the present disclosure, the phase wrap effect does not occur. In addition, the computation cost reduces since the data points outside the range are discarded.

In order to reduce or even remove the synchronization error of the microphones, the two microphones are controlled to start recording at the same time. However, the software instruction to open the microphones may not be executed simultaneously and the system time is accurate at millisecond level, which is far greater than the sampling interval of the microphones. The present disclosure provides a new system to achieve time synchronization of the microphones, which is illustratively shown in FIG. 5.

Figure 5:
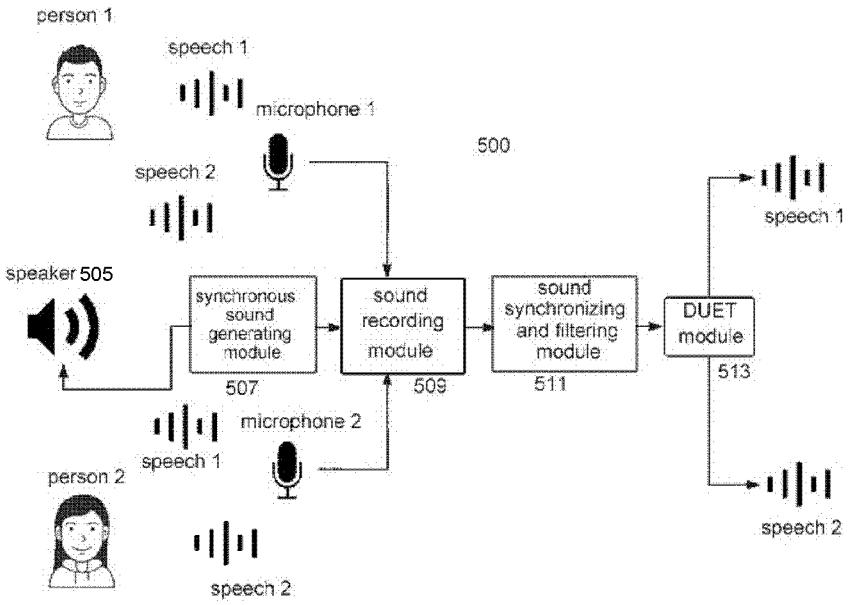
FIG. 5 is a block diagram of the system for voice separation according to an embodiment of the present disclosure.

FIG. 5 is a block diagram of the system for voice separation according to an embodiment of the present disclosure. As shown in FIG. 5, the system 500 includes a synchronous sound generating module 507 for controlling the speaker to generate a synchronous sound, a sound recording module 509 for storing the signals received from microphone 1 and microphone 2, a sound synchronizing and filtering module 511 for synchronizing the signals from microphone 1 and microphone 2, and DUET module 513 for voice separation. In various embodiments, the synchronous sound generating module 507, the sound recording module 509, and the filtering module 511 may be implemented by software, hardware, or the combination thereof. For example, they may be implemented by one or more processors.

The system 500 further includes a speaker 505 to generate a synchronous sound under the control of the synchronous sound generating module 507. The synchronous sound may be a trigger synchronous sound, which is emitted once after the microphones start recording the sound. Alternatively, the synchronous sound may be periodic synchronous sound. In addition, the synchronous sound may be inaudible for a human, such as, ultrasonic sound. The synchronous sound may be an impulse signal to facilitate identification. The speaker 505 may be provided on a point on a line which is perpendicular to the line between microphone 1 and microphone 2 and passes through the midpoint of those two microphones so that the speaker is equidistant from those two microphones.

The mixtures received from the microphones may include the synchronous sound, speech 1 and speech 2, and are stored in the sound recording module 509. The sound synchronizing and filtering module 511 detects the synchronous signal in the mixtures so as to synchronizes the two mixtures. Then, the sound synchronizing and filtering module 511 removes the synchronous sound from the two mixtures. The synchronous sound may be removed by a filter or an appropriate algorithm.

According to the present embedment, time synchronization may achieve the accuracy of the microsecond level. For example, if the recording frequency is 44.1 KHz, the accuracy of time synchronization may be less than ten microseconds.

The synchronized signals are inputted into DUET module 513 for voice separation. The DUET module 513 is the same as the DUET module 312 as shown in FIG. 3. Nonetheless, it may not be necessary to measure the largest synchronization error of the microphones in terms of the sampling points, and the clustering range of the relative delay is calculated by the equation (8). Further, if the distance between two microphones is small enough, the clustering range of the relative delay may be $$\left[-f_s\frac{d}{c},\ f_s\frac{d}{c}\right].$$

Figure 6:
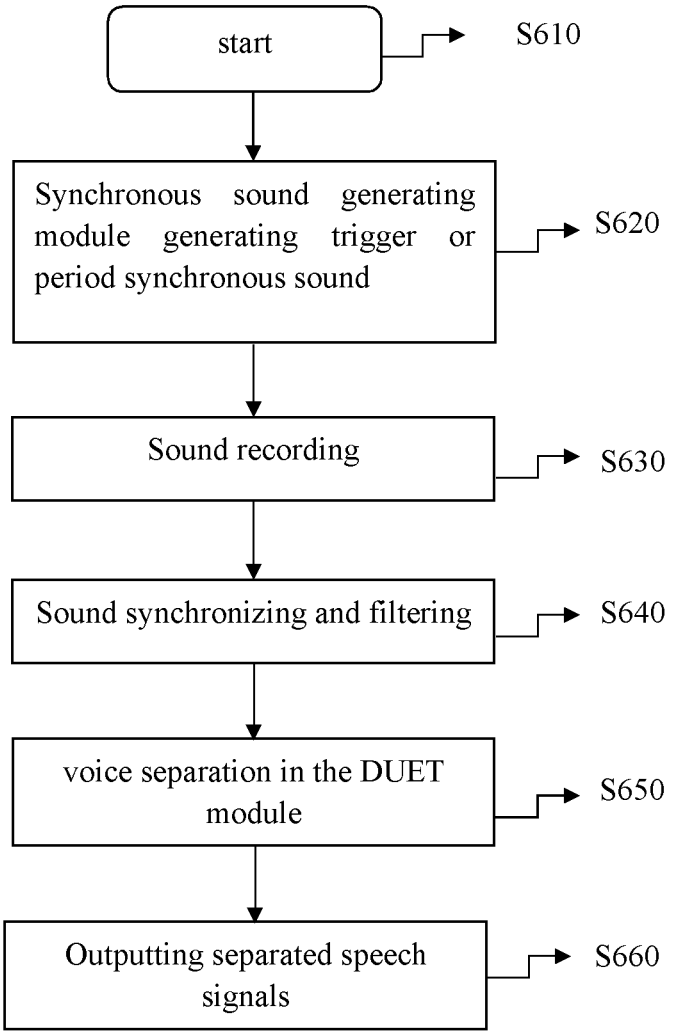
FIG. 6 is a flow diagram of the voice separation according to an embodiment of the present disclosure.

FIG. 6 is a flow diagram of the voice separation according to an embodiment of the present disclosure.

As shown in FIG. 6, the method begins at step S610, where the microphones start to sample the sound. At step S620, the synchronous sound generating module 507 controls the speaker to generate a trigger or period synchronous sound. The received mixtures, i.e., the signals received from the microphones, are stored in a memory at step S630. The mixtures are synchronized by using the synchronous sound, and then the synchronous sound is filtered out from the mixtures (S640), which has been described with reference to the sound synchronizing and filtering module 511. The synchronized mixtures are inputted to the DUET module 513, and the DUET module 513 performs the voice separation (S650) and outputs the separated speech signals (S660). The process of the DUET module 513 has been described with reference to FIG. 1.

The method and the system in the aforesaid embodiments of the present disclosure may realize the synchronization of the microphones, and thus improve the accuracy and the efficiency of the DUET algorithm with relatively low cost.

It will be understood by persons skilled in the art, that one or more units, processes or sub-processes described in connection with FIGS. 1-6 may be performed by hardware and/or software. If the process is performed by software or the unit is implemented by software, the software may reside in software memory (not shown) in a suitable electronic processing component or system, and may be executed by the processor. The software in the memory may include executable instructions for implementing logical functions (that is, "logic" that may be implemented either in digital form such as digital circuitry or source code or in analog form such as analog circuitry or an analog source such as an analog electrical signal), and may selectively be embodied in any computer-readable medium for use by or in connection with an instruction execution system, apparatus, or device. The computer readable medium may selectively be, for example, but is not limited to, an electronic, magnetic, optical, electromagnetic, infrared, or semiconductor system, apparatus or device, such as, a RAM, a ROM, an EPROM, etc.

With regard to the processes, systems, methods, heuristics, etc., described herein, it should be understood that, although the steps of such processes, etc., have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims.

To clarify the use in the pending claims and to hereby provide notice to the public, the phrases "at least one of <A>, <B>, . . . and <N>" or "at least one of <A>, <B>, . . . <N>, or combinations thereof" are defined by the Applicant in the broadest sense, superseding any other implied definitions herebefore or hereinafter unless expressly asserted by the Applicant to the contrary, to mean one or more elements selected from the group comprising A, B, . . . and N, that is to say, any combination of one or more of the elements A, B, . . . or N including any one element alone or in combination with one or more of the other elements which may also include, in combination, additional elements not listed.

While various embodiments of the disclosure have been described, it will be apparent to those of ordinary skill in the art that many more embodiments and implementations are possible that are within the scope of the disclosure. Accordingly, the disclosure is not to be restricted except in light of the attached claims and their equivalents.

The invention claimed is:

1. A method for voice separation based on a degenerate unmixing estimation technique (DUET), the method comprising receiving signals from microphones;

performing a Fourier transform on the received signals to output data points;

calculating a relative attenuation parameter and a relative delay parameter for a corresponding data point;

selecting a clustering range for the relative delay parameter based on a distance between the microphones and a sampling frequency of the microphones, clustering the data points within the clustering range for the relative delay parameter into subsets, and performing an inverse Fourier transform on each of the subsets to output separated signals corresponding to different sources, wherein the selecting the clustering range for the relative delay parameter is further based on a maximum frequency in a voice.

2. The method of claim 1, further comprising setting the cluster range of the relative attenuation parameter as a constant.

3. The method of claim 1, wherein the clustering range for the relative delay parameter is given by:

$$\left[-\frac{f_s}{2f_{MAX}},\ \frac{f_s}{2f_{MAX}}\right]\cap\left[-f_s\frac{d}{c}-n_0,\ f_s\frac{d}{c}+n_0\right]$$

wherein $f_s$ is the sampling frequency of the microphones, d is a distance between the microphones, $f_{max}$ is a maximum frequency in a speech, c is a speed of sound, and $n_0$ is a largest synchronization error of the microphones in terms of data points.

4. The method of claim 1, further comprising generating a synchronous sound by a speaker to synchronize the received signals.

5. The method of claim 4, further comprising filtering out the synchronous sound from the received signals.

6. The method of claim 4, wherein the synchronous sound is generated once or periodically.

7. The method of claim 4, wherein the synchronous sound is ultrasonic sound.

8. The method of claim 1, when $$d \le \frac{c}{2f_{MAX}},$$

and the signals received from the microphones are synchronized, the clustering range for the relative delay parameter is given by $$\left[-f_s\frac{d}{c},\ f_s\frac{d}{c}\right],$$

wherein $f_s$ is a sampling frequency of the microphones, d is a distance between the microphones, $f_{max}$ is a maximum frequency in speech, and c is a speed of sound.

9. A system for voice separation based on a degenerate unmixing estimation technique (DUET), the system comprising a sound recording module configured to store signals received from the microphones;

a processor configured to:

perform a Fourier transform on the received signals to output data points;

calculate a relative attenuation parameter and a relative delay parameter for a corresponding data point;

select a clustering range for the relative delay parameter based on a distance between the microphones and a sampling frequency of the microphones, cluster the data points within the clustering range for the relative delay parameter into subsets; and perform an inverse Fourier transform on each of the subsets to output separated signals corresponding to different sources, wherein the processor is further configured to select the clustering range for the relative delay parameter based on a maximum frequency in a voice.

10. The system of claim 9, wherein the processor is further configured to set the clustering range of the relative attenuation parameter as a constant.

11. The system of claim 9, wherein the clustering range for the relative delay parameter is given by:

$$\left[-\frac{f_s}{2f_{MAX}},\ \frac{f_s}{2f_{MAX}}\right]\cap\left[-f_s\frac{d}{c}-n_0,\ f_s\frac{d}{c}+n_0\right]$$

wherein $f_s$ is a sampling frequency of the microphones, d is a distance between the microphones, $f_{max}$ is a maximum frequency in speech, c is a speed of sound, and $n_0$ is a largest synchronization error of the microphones in terms of data points.

12. The system of claim 9, further comprising a speaker configured to generate a synchronous signal for synchronizing the signals received from the microphones.

13. The system of claim 12, further comprising a synchronous and filtering module configured to synchronous the signals received from the microphones with the synchronous signal and to filter out the synchronous signal from the received signals.

14. The system of claim 12, wherein the synchronous sound is generated once or periodically.

15. The system of claim 9, wherein the system is implemented in a head unit of a vehicle.

16. The system of claim 9, when $$d \le \frac{c}{2f_{MAX}},$$

and the signals received from the microphones are synchronized, the clustering range for the relative delay parameter is given by $$\left[-f_s\frac{d}{c},\ f_s\frac{d}{c}\right],$$

wherein $f_s$ is a sampling frequency of the microphones, d is a distance between the microphones, $f_{max}$ is a maximum frequency in speech, and c is a speed of sound.

17. A non-transitory computer-readable storage medium including instructions that, when executed by one or more processors to perform the steps of:

performing a Fourier transform on signals received from microphones to output data points;

calculating a relative attenuation parameter and a relative delay parameter for corresponding data point;

selecting a clustering range for the relative delay parameter based on a distance between the microphones and a sampling frequency of the microphones, clustering the data points within the clustering range for the relative delay parameter into subsets, and performing an inverse Fourier transform on each of the subsets to output separated signals corresponding to different sources, wherein the selecting the clustering range for the relative delay parameter is further based on a maximum frequency in a voice.

* * * * *